US007740011B1

(12) United States Patent
Bernardy

(10) Patent No.: US 7,740,011 B1
(45) Date of Patent: Jun. 22, 2010

(54) ARCHERY BOW

(76) Inventor: Eckhard Bernardy, P.O. Box 1226, Woodland, WA (US) 98674

( * ) Notice: Subject to any disclaimer, the term of this patent is extended or adjusted under 35 U.S.C. 154(b) by 695 days.

(21) Appl. No.: 11/394,569

(22) Filed: Mar. 31, 2006

Related U.S. Application Data

(60) Provisional application No. 60/668,225, filed on Apr. 2, 2005.

(51) Int. Cl.
*F41B 5/00* (2006.01)

(52) U.S. Cl. ..... 124/23.1; 124/16

(58) Field of Classification Search ..... 124/16, 124/23.1, 25.6, 86, 88
See application file for complete search history.

(56) References Cited

U.S. PATENT DOCUMENTS

| | | | | | |
|---|---|---|---|---|---|
| 428,912 | A | * | 5/1890 | Holmes | 124/23.1 |
| 1,932,195 | A | * | 10/1933 | Stroup | 124/22 |
| 3,486,495 | A | | 12/1969 | Allen | |
| 3,674,001 | A | * | 7/1972 | Hitt | 124/23.1 |
| 3,744,473 | A | * | 7/1973 | Nishioka | 124/25.6 |
| 3,981,290 | A | * | 9/1976 | Islas | 124/25.6 |
| 4,041,927 | A | | 8/1977 | Van House | |
| 4,287,867 | A | | 9/1981 | Islas | |
| 4,756,295 | A | | 7/1988 | Guzetta | |
| 5,150,699 | A | | 9/1992 | Boissevain | |
| 5,373,831 | A | * | 12/1994 | Cushman | 124/25.6 |
| 5,454,361 | A | * | 10/1995 | Bronnert | 124/23.1 |
| 5,706,794 | A | * | 1/1998 | Neal | 124/25.6 |

OTHER PUBLICATIONS

Author unknown, Compound Bow Selection Guide, found online at http://www.huntersfriend.com/bowselection.htm, Mar. 30, 2006, pp. 1-12, published by Hunter's Friend LLC.

Author unknown, Modern Archery Equipment and Terms, found online at http://library.thinkquest.org/27344/modern.htm, Mar. 30, 2006, pp. 1-4, publisher unknown.

Author unknown, Compound Bow, found online at http:en.wikipedia.org/wiki/Compound_bows, Mar. 30, 2006, pp. 1-2, published by Wikipedia.

* cited by examiner

*Primary Examiner*—John Ricci

(57) ABSTRACT

An archery bow includes a bottom limb with first and second ends, a top limb with first and second ends, a leaf spring attached to the bottom limb, a bowstring spanning limb distals pivotally connected top and bottom limbs, such that a cantilevered second end of the top limb enacts a tension on the spring. A bow includes a bottom limb with first and second ends, an axial slot in the second end, a front and rear slat, a top limb with first and second ends, wherein the second end fits movably within the slot, a bowstring spanning limb distals, top and bottom limbs pivotally connected, such that a cantilevered second end of the top limb movingly fits the slot and drawback deforms the slats. A bow includes opposing limbs pivotally connected with spaced distal ends spanned by a bowstring, a cantilevered limb directly enacting a tension on a spring on the opposing limb.

16 Claims, 4 Drawing Sheets

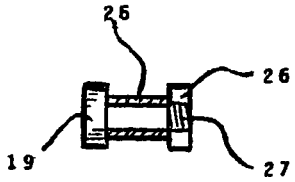
FIG. 6
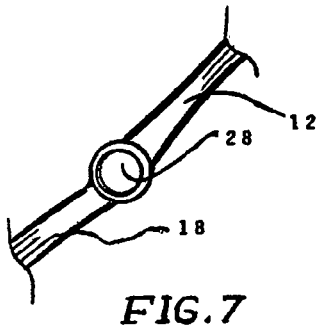
FIG. 7
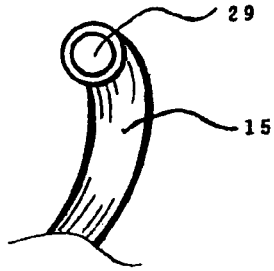
FIG. 8
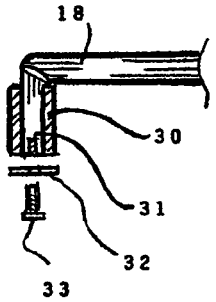
FIG. 9
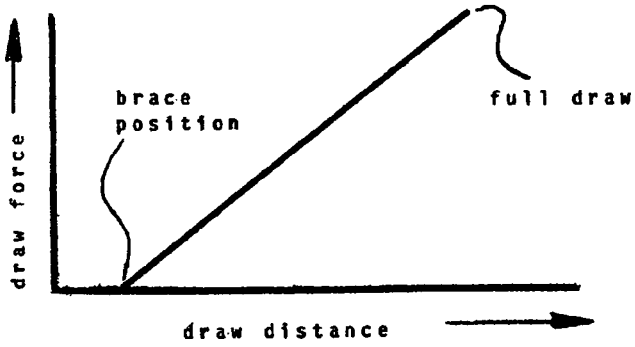
FIG. 10
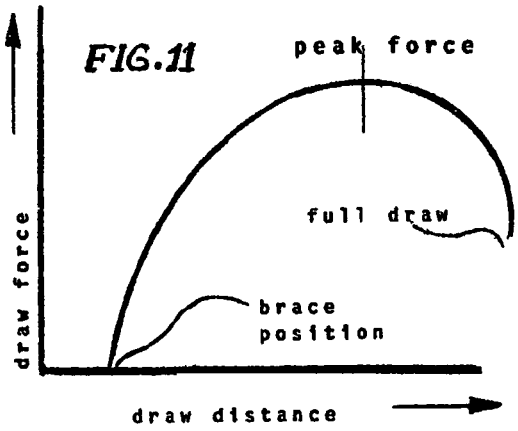
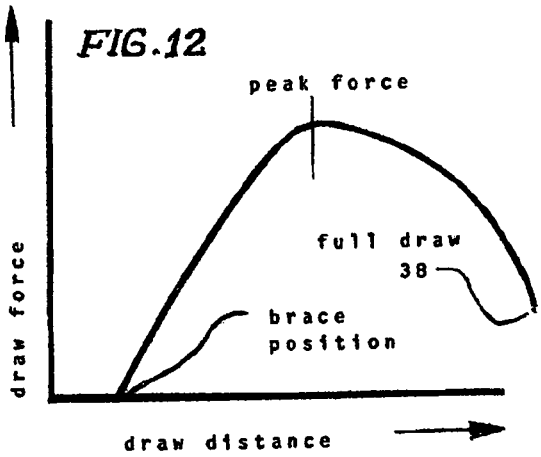

FIG. 13
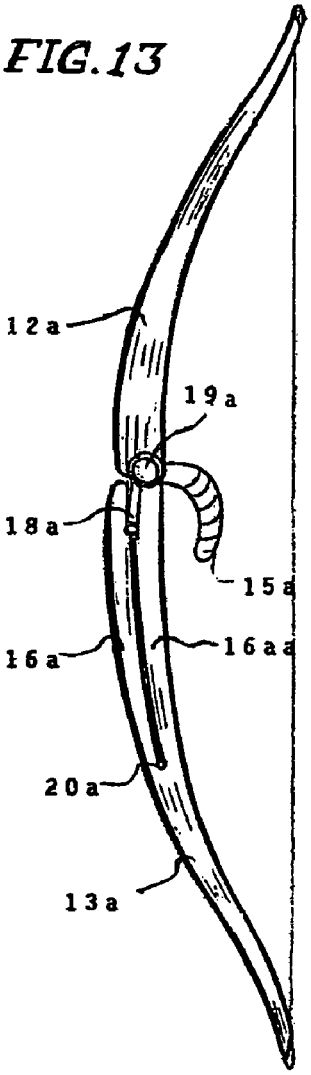
FIG. 14
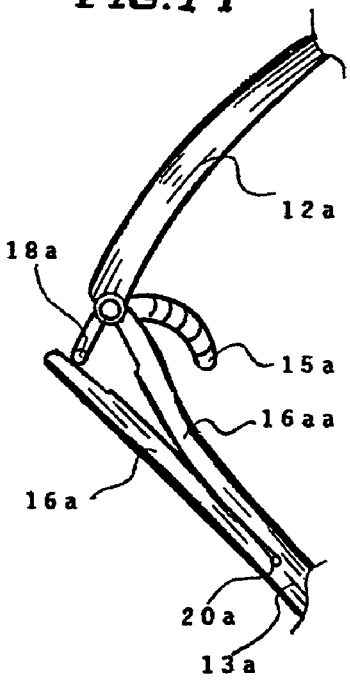
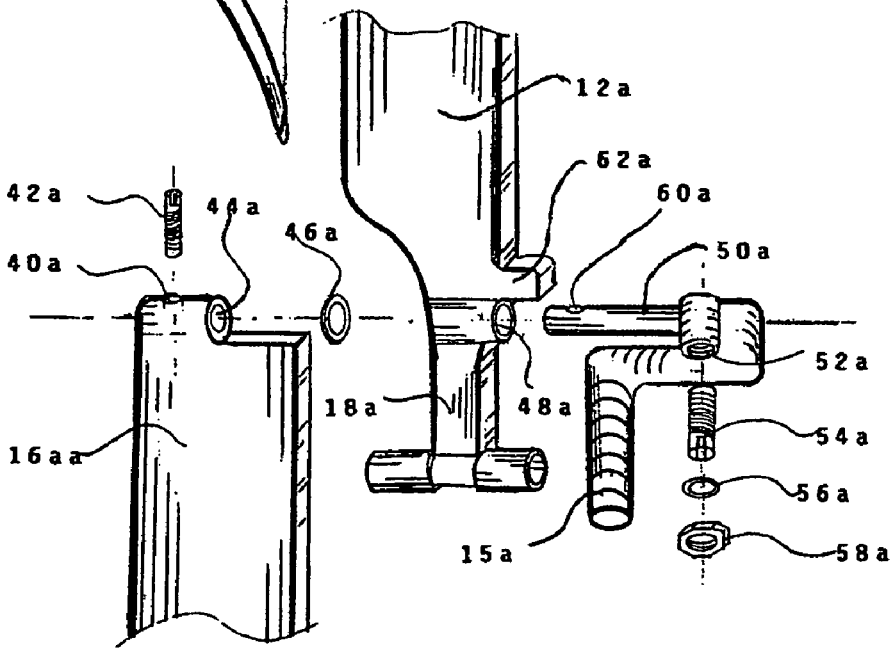
FIG. 15

ARCHERY BOW

CROSS-REFERENCE TO RELATED APPLICATION

This application claims the benefit of priority to provisional patent application Ser. No. 60/668,225, filed 2005 Apr. 2 by the present inventor.

FIELD OF THE INVENTION

This invention relates generally to archery bows and specifically to compound bows.

BACKGROUND

Compound bows have mechanisms to reduce draw tension in the fully drawn position. This enables the archer to aim under less physical stress and augments precision. In addition, more powerful bows can be used, with inherent advantages.

Compound bows both gather and release energy asymmetrically; no longer reliant on Hooke's law of linearity. During release, energy transfer to the arrow is at first relatively mild, then quickly maximizes—but drops again near the arrow release point from the string. This lessens arrow shock, diminishing a phenomenon related to 'Archers Paradox', wherein the sudden action of compressive force through the knock down the length of the arrow, causes shaft bending or bowing from side to side in a series of diminishing in-flight cycles. While flexing of the arrow shaft has little effect on accuracy, it consumes energy and disturbs airflow, making it undesirable.

The reduction in draw string tension at full draw, termed 'let off', is a significant and fairly recent improvement in archery's long history. However, this advance came at a price, as the 'let off' mechanisms added structural complexity and visual distraction. Multiple pulleys, cables and various extraneous devices clutter most compound bows which to boot, often need repeated adjustment or 'tuning' to perform well. The added complexity also adds costs in manufacture. And last, but to purists not least, compound bows typically lack the traditional bow's time honored simple elegance and visual grace of appearance.

U.S. Pat. No. 3,486,495 to Allen (1969) is the grandfather to modern compound bows. Characteristically, this type of compound bow has an over-center feature inherent in the pulleys at the limb ends, as depicted in FIG. 1. This provides the desired degree of 'let off' at full draw, shown on FIG. 6. The several cables shown present a problem in that only one is drawn back in the nook of the arrow. The other two must somehow be accommodated to one side, lest they interfere with the centered arrow. Unfortunately, a lateral shifting of the cables under tension also shifts draw forces to one side and a certain amount of undesirable twist is thus introduced into the bow's long axis. Imperfect synchronous action of the two separate bow arms, is another problem inherent in this design and frequent tuning may be needed to maintain proper equilateral balance.

U.S. Pat. No. 4,756,295 to Guzetta (1988) shows a bow of even greater complexity than the Allen design. Not only are there two separately acting bow arms attached to a riser, but an array of power links, toggle links, adjustable inter-limb connectors are all hooked to a 'power cylinder', containing a coil spring and actuated piston, etc., as illustrated on FIGS. 2 through 7. It is unclear, if this design offers any improved performance at all, despite its apparent complexity. It may even be that the frictional losses incurred with all those linkages, offset any possible performance enhancement. What is clear, is that it has little in common in appearance with the traditional archery bow and that it lacks aesthetic appeal with that much paraphernalia.

U.S. Pat. No. 5,150,699 to Boissevain (1992) illustrates a bow claiming to reduce draw force at full draw. An intricate system of adjustable cables and pulleys coordinates forces generated by a single spring against two rigid bow arms and is again needlessly complicated to achieve the desired result, as evident by FIGS. 1 & 3.

U.S. Pat. No. 3,981,290 to Islas (1976) shows a bow which again achieves draw force reduction at full draw at the cost of considerable complexity, as is clearly illustrated by the FIGS. 4, 5, and 8. A pulley system is needed to synchronize the limb members, multiple cantilevered springs with adjustable backstops store energy, but also harbor opportunity for disequilibrium and need for adjustment. The design is far too complex to be practically useful, as the market has borne out.

U.S. Pat. No. 4,041,927 to Van House (1977) is a relatively simple design, utilizing a single load spring for the energy medium, however, since a riser and two attached limbs are used, the latter must again be synchronized in their movement, which is accomplished through a hollowed out riser, cable and pulleys and further an attached system of levers, acting against the single spring of this bow which again in the end is unnecessarily complicated to achieve the desired end. The bow further appears decidedly ungainly with all its extraneous spring and levers attachments.

U.S. Pat. No. 4,287,867 to Islas (1981) provides for maximum draw pull at an intermediate draw position and therefore has 'let off' at maximum pull to assists aiming. However, this effect is again overshadowed by wild complexity. Two movable arms are attached to a common riser and actuated via cams, control cables and cantilevered upper and lower spring members. Arm tension is maintained through a hidden cable in a riser passage and the opportunity for imperfect tension equalization and need for continued fine tuning is pronounced.

U.S. Pat. No. 3,674,001 to Hitt (1972) is an example of a largely conventional bow, to but with auxiliary arms in conjunction with master arms and a claim to generate an increased projectile propelling force. However, since the auxiliary limbs are in sliding contact with the master arms, frictional losses are incurred upon arrow release. It would appear that a more powerful bow could be had by simply strengthening the master arms. This would further reduce a needless complexity. Either way, this design has maximum string pull at full draw and thus offers no archer's relief or 'let off' for relaxed aiming.

The teachings of each of the above-listed citations (which does not itself incorporate essential material by reference) are herein incorporated by reference. None of the above inventions and patents, taken either singularly or in combination, is seen to describe the instant invention as claimed.

Heretofore, no formerly developed archery bow stores sufficient energy along with significant full draw 'let off' while preserving a simple, relatively uncluttered appearance that many find so appealing in traditional bow design. All compound bows hereto known suffer from one or more of the following disadvantages: (a) Their manufacture is unnecessarily complex and costly because their designs are unnecessarily complicated; (b) The problem of achieving 'let off' is solved on conventional compound bows through various systems of pulleys and multiple cables, along with assortments of levers and auxiliary springs; (c) Use of systems of pulleys, multiple cables and levers, etc. often introduces a precarious balance between the bow arms which must be maintained through careful, repeated adjustments or tuning; (d) Auxiliary cables parallel to the cable serving as bow string, require a mechanism to shift these sideways from their natural centered position, in order to avoid interference with the arrow creating a lateral displacement which introduces an undesirable twisting action into the bow's longitudinal axis; (e) The structure and add-on paraphernalia found on conventional compound bows is an aesthetically unpleasant departure from traditional bow design and degrades the simple, time honored, graceful elegance of classic bows into unsightly, machine-like devices.

SUMMARY AND ADVANTAGES

An archery bow includes a bottom limb with first and second ends, a top limb with first and second ends, a leaf spring attached to said bottom limb, a bow string connected to said first end of said bottom limb and to said first end of said top limb, wherein said top limb is pivotally connected to said bottom limb at a point distal from said second end of said top limb, such that the cantilevered second end of the top limb deforms said leaf spring when said bow string is drawn back.

An archery bow includes a bottom limb with a first and second ends, wherein said second end has an axial slot extending from the tip of said second end to a point distal from the tip of said second end, a front slat, and a rear slat, a top limb with a first end and a second end, wherein said second end is sized to fit movably within said axial slot in said bottom limb, a bow string connected to said first ends of said top and bottom limbs, wherein the top limb is pivotally connected to the bottom limb at a point distal from the second end of the top limb, such that the cantilevered second end of the top limb fits movingly within the slot and deforms the front slat when the bow string is drawn back.

An archery bow includes first and second opposing limbs pivotally connected with spaced distal ends, a spring member connected to said second limb, a lever connected to said first limb and tension acting on said spring member, a string spanning distal ends of said first and second opposing limbs.

The archery bow of the present invention presents numerous advantages, including: (a) providing a compound bow of the simple possible structure with top performance and a high degree of 'let off' at full draw, far simpler in comparison with conventional compound bows; (b) providing a compound bow where its simple structure yields obvious manufacturing, marketing and maintenance advantages; (c) providing a compound bow which has natural limb tension equilibrium and therefore avoids all balance or tuning problems; (d) providing a compound bow which has no auxiliary cables and therefore requires no lateral cable offsetting device, thus avoiding introduction of twisting forces into the bow's longitudinal axis; (e) providing a compound bow which avoids the clutter of excessive, unsightly add-on paraphernalia found on virtually all conventional compound bows; (f) providing a compound bow which largely retains the classic appearance of traditional bows; (g) providing a compound bow which can be quickly and easily dismantled into its major components for convenient storage or transport; (h) providing a compound bow with a wide range of adjustable 'let off'; (i) providing a compound bow with exchangeable spring elements to accommodate archers with different draw strength preferences; (j) providing a compound bow with several different spring element design options; (k) provides a simplicity in structure that offers cost savings in manufacture which can translate into a more competitive market position; (l) providing aesthetic appeal that can translate into marketing success; (m) providing bow limbs which require not 'tuning'; (n) eliminating the cable jangle, the auxiliary cables needed to be squeezed sideways, present in conventional compound bows; (o) providing a convenient change of draw weight by simply exchanging the spring; (p) providing performance competitive with conventional compound bows; (q) providing a substantial release 'valley' for relaxed shooting; and (r) providing a draw tension release mechanism that can be used on cross bows, since there is no cable clutter to deal with and lighter, smoother, trigger mechanisms can be used.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

FIG. 6 is a side elevation cross cut of the bushed pivot.

FIG. 7 is a side view of the pivot end of the upper bow arm with lever arm.

FIG. 8 is a side view of the pivot end of the lower bow arm with the handle.

FIG. 9 is a top sectional view of the extended bushed lever arm with washer and screw.

FIG. 10 is a schematic of draw force characteristics of traditional bows.

FIG. 11 is a schematic of draw force characteristics of typical compound bows.

FIG. 12 is a schematic of draw force characteristics of the bow of the present invention.

FIG. 13 is a side elevation view of an alternative embodiment of the bow showing one bow arm partially divided into two spring elements and a separately mounted handle.

FIG. 14 shows in side elevation the alternative embodiment mechanism in full draw position.

FIG. 15 shows a rear view of the alternative embodiment of the bow parts assemblage in exploded format.

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

FIGS. 1-12

First Embodiment

Figure 1:
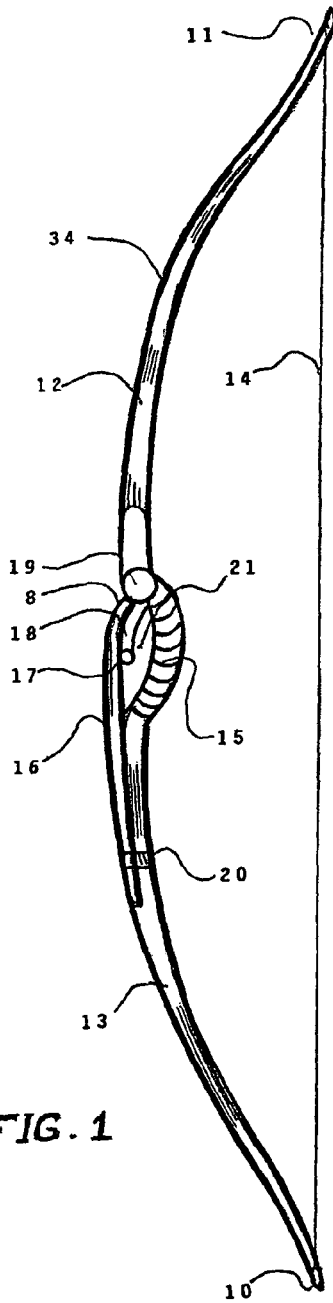
FIG. 1 is a side elevation drawing of the most basic embodiment of the bow showing two opposing arms, a central pivot point and a cantilevered spring integral to one arm and an integrated handle and short lever arm extending beyond the pivot point of the opposing arm.

FIG. 1 is a left side view of braced bow 34. The bow has two movable arms: upper arm 12 and lower arm 13. Both arms are pivotally joined at 19. Cantilevered spring 16 may be single leaf (as shown) or multiple blade spring (not shown). Spring 16 is attached at 20 to lower arm 13. The spring is slightly curved at 8. An extension of the upper arm 12 reaches beyond pivot 19 and forms a short lever arm 18 which terminates at 17. Lever arm 18 nests within the curvature 8 of spring 16. Bow string 14 is conventionally attached to arms 12 and 13 at 10 and 11, respectively. Handle 15 is located next to pivot 19 on lower arm 13. Sufficient hand spacing 21 is provided forward of handle 15. A simple internal hand guard may be added to provide additional protection (not shown).

Figure 2:
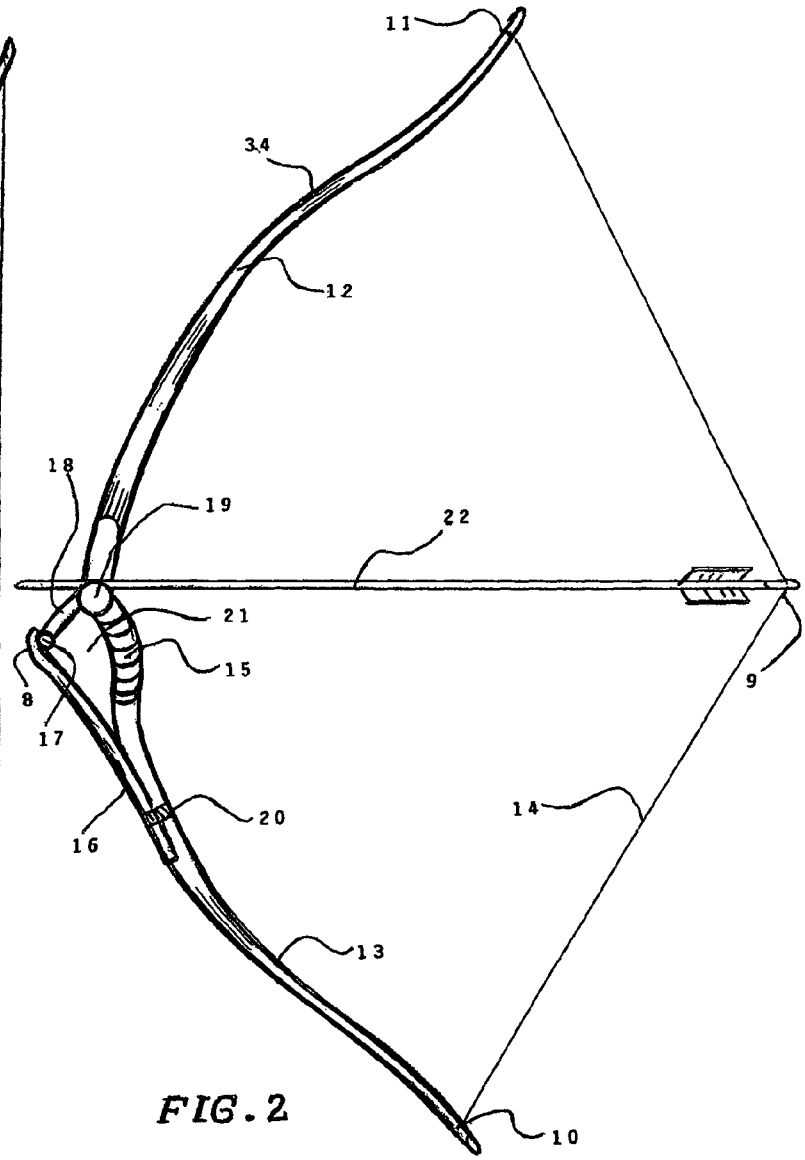
FIG. 2 is a side elevation drawing of the bow with an arrow and bow-string in fully drawn position and the draw force reduction mechanism actuated.

FIG. 2 is, from archer's perspective, a left side view of fully drawn bow 34, with arrow 22 nocked at 9 and resting at pivot 19. Round 17 of lever arm 18 rests in a corresponding nook on the opposite of semi-rounded section 8. Arms 12 and 13 are fully arched in full draw position. All other elements are as described in FIG. 1 above.

Figure 3:
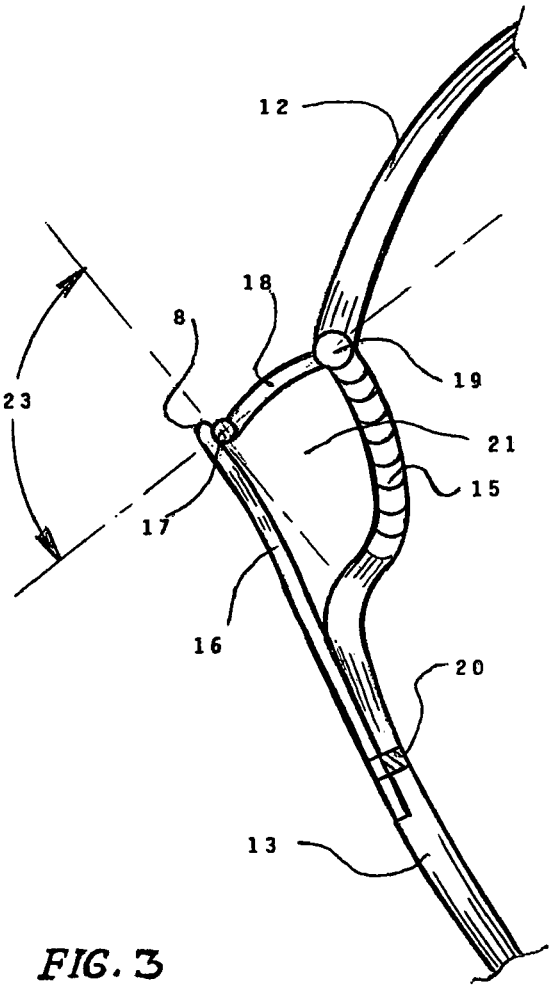
FIG. 3 is an expanded side elevation view with truncated bow arms and of the actuated draw force reduction mechanism, illustrating the angularity.

FIG. 3 is, from archers perspective, an expanded left side view of the draw force mechanism with the bow in full draw position. Lever arm 18 is near 90 degrees to an imaginary line drawn through the spring contacted at a bushed round 17, where friction may be further reduced by the use of needle bearings (not shown) and opposite curvature 8, indicated at 23, but this angle can be somewhat greater than shown. Upper arm 12, opposes lower arm 13 with pivot 19 at center. Handle 15 is now further from spring 16, widening hand space 21. Fastening device 20 is unchanged.

Figure 4:
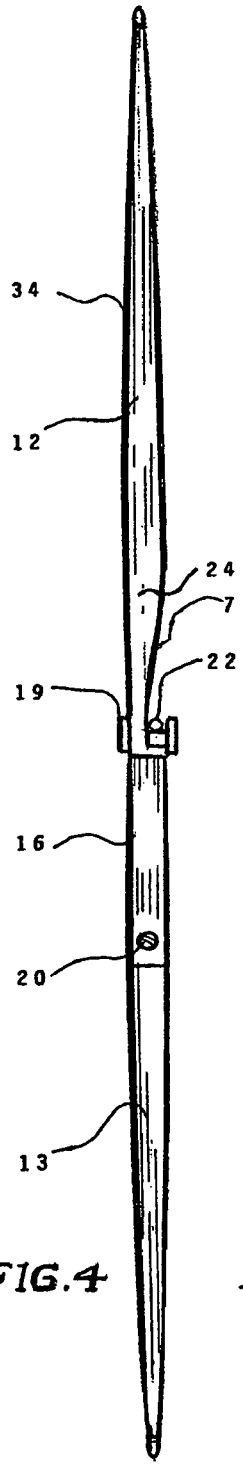
FIG. 4 is a front elevation drawing of the bow, showing the structure used for arrow shaft placement and also detail of spring fastening.

FIG. 4 is, from archer's perspective, a full frontal view of bow 34, showing upper arm 12 lower arm 13, fastening means 20, center line 23, spring 16 and pivot pin 19. Limb 12 has a recess at 7. Pivot pin 19 shows cross sectional arrow 22.

Figure 5:
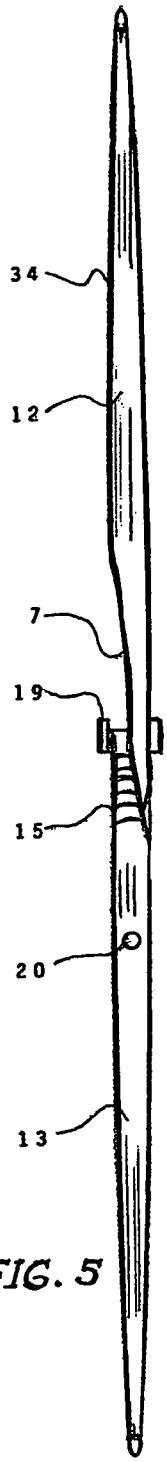
FIG. 5 is a rear elevation drawing of the bow and pivot structure.

FIG. 5 is, from archer's perspective, a full rear view of bow 34, showing arms 12 and 13, spring fastening means 20, handle 15, pivot pin 19, and recess 7 to allow central arrow positioning. The bow arm segment at 7 is narrow, but thickened to compensate (not shown).

FIG. 6 shows a cross sectional view of the pivot pin 19, also cut threads 27, threaded nut 26 and anti friction bushing 25. The pivot pin is inserted into corresponding holes 28 and 29 of the bow arms.

FIG. 7 shows truncated upper limb 12 with hole 28 (for pivot pin) and truncated lever arm 18.

FIG. 8 shows, by user's perspective, lower arm truncated handle 15 and pivot pin hole 29.

FIG. 9 shows, by user's perspective, a sectional, frontal, truncated lever arm 18 with anti-friction bushing 30, threaded screw hole 31, retaining washer 32 and screw 33.

Operation—FIGS. 1, 2, 3, 4, 6, 9, 10, 11, 12, The manner of using the bow of FIG. 1 is completely conventional. Draw string 14 is pulled back and two opposing bow arms 12 and 13 arch rearward as shown by FIG. 2. However, the bow arms are unconventionally rigid and pivotally connected at 19 to allow movement. During draw, lever 18, an extension of bow limb 12, uses pivot 19 to act upon spring 16. Since the lever is quite short in relation to the bow arm, there is considerable force multiplication and a powerful spring can be actuated. It is the energy stored in this spring which powers the bow.

The spring is already pre-tensioned in the direction of the lever prior to mounting. This provides sufficient initial tension for the bow's brace (string taut, but not drawn back) position. Otherwise, initial draw would be used to bring the bow into a braced position and performance decline.

The spring has curvature 8 at its end, best seen at FIG. 3. When round 17 of to lever 18 is lodged in the inside radius of 8, the bow is at full draw. The radius is a practical stop to further expand the draw. Full draw also coincides with maximum 'let off'. If the bow has a draw weight of 50 pounds, then the archer must pull that weight to achieve full draw. However, already near full draw, the angularity between lever 18 and spring 16 approaches right angle and substantial draw force relief will be provided. Depending on the exact angularity, 'let off' may be dramatic, at say, 50%. Suddenly, the archer is relieved of half the strain. He or she cannot fail to notice, because draw strain has just declined by 25 pounds. There is no motivation to further expand the draw in this position and relaxed aiming can take place. The length of the exchangeable spring determines the degree of 'let off', its strength determines draw weight.

'Let off' is an undesirable 100% when the angle formed by lever 18 and spring 16 is at right angle. But 'let off' is also already 100% somewhat before 90 degrees of angle. Since frictional properties of both pivot and lever end also play a role and because there is variability between applications, the data must be approximated. In General 'let off' begins to become effective at approximately 75 degrees. The desired amount of 'let off' is therefore within somewhat less than a 15 degree range of angularity. Since this bow has moving, interactive parts, care is taken to reduce frictional power losses. Pivot point 19 and lever round 17 are bushed or have needle bearings (not shown), illustrated at FIGS. 6 and 9, at 25 and 30, respectively.

Arrow placement is conventional as shown by FIG. 4, at 22. Sufficient 'let off' provides the archer with more physically relaxed aim at full draw. However, as the bow string is released, the bow's draw characteristics are replayed—in reverse. Even with a relatively light draw weight, it is not always easy to maintain full draw in perfect, steady position. It may be remembered that traditionally only three or even two fingers control the tightly drawn bow-string. It is therefore undesirable, that with only a slight movement forward of the string fingers, the archer suddenly engages the full, original and unmodified draw weight of the bow. The distance the archer can back away safely from a fully drawn and 'let off' position is termed the 'valley'. Large 'valleys' are more forgiving than small ones and therefore more desirable.

FIG. 10 schematically shows the draw force of a traditional (non-compound) bow, indicating linearity without 'let off' and also, without 'valley'. The draw force diagram of FIG. 11 is that of a typical Allen-type compound bow, depicting an asymmetrical draw force curve and both 'let off' and a 'valley'. The diagram of the present bow reflects a fairly linear draw force curve instead, but also dramatic 'let off' and a generous 'valley' as seen by FIG. 12.

FIGS. 13, 14, 15

Second Embodiment

An second embodiment is shown by FIGS. 13, 14 and 15. FIG. 13 presents alternative structure with modified spring configuration and handle assembly. Instead of an externally mounted single spring element, the lower arm has a lengthy bifurcated portion reaching from the bow's center to junction 20*a*. This forms spring elements 16*a* and 16*aa*. Handle 15*a* is an extension of both axis and axle to bow arms 12*a* and 13*a* at pivot 19*a*. Only the inner spring, 16*aa* is attached to the pivot 19*a* at the bow's center, while the outer spring moves freely. The actuating mechanism is the already familiar system based on lever 18*a*, only now the lever acts to store energy not only in outer spring member 16*a*, but additionally in inner spring member 16*aa*.

FIG. 14 illustrates the actuating mechanism in a fully drawn position. Limbs 12*a* and 13*a* are arched back, lever 18*a* is in near right angle juxtaposition with spring member 16*a* and spring member 16*aa* is bent rearward. Handle 15*a* is moved somewhat rearward but with relatively unaffected angularity.

FIG. 15 provides additional detail in an exploded view. A further departure from the basic configuration is presented by a screw-type 'let off' adjustment mechanism. To this purpose, an abutment plate 62*a* is provided near the base of the upper bow limb 12*a*. A housing, 52*a*, drilled and tapped to take adjustment screw 54*a* and washer 56*a* with lock nut 58*a*, is integral to the handle. The adjustment mechanism allows for on the spot 'let off' modification.

The handle also comprises shaft 50*a*, or the axle of the bow. The shaft portion has hole 60*a*, leading substantially into the shaft. The hole is sized to receive screw 42*a* during assembly, as the shaft is moved into mounting hole 46*a* of spring member 16*aa*. The spring member is drilled and tapped at 40*a* for screw 42*a*. Spring washer 46*a* takes up any lateral slack, while mounting hole 48*a* is part of upper bow arm 12*a* which further has lever arm 18*a*. The bow can be folded up by backing out screw 42*a* from shaft hole 60*a*, or it can be dismantled completely for compact storage or transport.

It is also possible to construct the described bows from a variety of materials, including wood, metals, epoxies, fiberglass and carbon fiber. Those with skill in the art will know the resiliency and strength required for bow limbs can be satisfied by a number of materials There are additional embodiments possible. For example, a third embodiment could use a triad spring arrangement, where the lower bow arm is laterally and longitudinally divided into three spring members. The outer members can be fastened to the pivot, while the inner member would be free to move in the opposite direction when urged by the lever arm.

In operation the archer applies the lever mechanism to reduce the effort required to hold the bow in a fully drawn position. An archer can also adjust the mechanism to his or her draw weight preference by simple exchange of a spring or by making a quick screw adjustment. Reduction of draw effort in the manner described, enhances the archer's performance by reducing physical stress. It simultaneously enhances the bow's performance characteristics by reducing initial compressive force transmitted into the arrow shaft, allowing the use of lighter, faster arrows for greater speed and distance, or alternately—more powerful bows to the same end.

Although the above description contains many specificities, these should not be construed as limiting the scope of the invention, but merely providing illustrations of some of the presently preferred embodiments of this invention. For example, the simple bow handle can have other shapes and be optimally designed to match specific hand sizes, with finger indents, etc. Also the bow limbs can have different shapes from the semi-recurve design shown. They may be 'palintonos', or of a reverse curvature, or they may be simply straight as the English longbow, or have some other shape. The limbs may be shortened, thickened, widened, etc.

The same possibility of variation also applies to the 'let off' mechanism itself. The geometry can be modified. For example, the lever arm can be of different length and shape. The spring members may be changed in number, size and shape, etc. The draw force reduction mechanism would also be useful for crossbows, where the auxiliary cables of conventional compound bows would interfere with drawstring and arrows, but the simplified structure of the present invention would allow use of lighter and smoother trigger mechanisms.

Those skilled in the art will recognize that numerous modifications and changes may be made to the preferred embodiment without departing from the scope of the claimed invention. Modifications of the invention, in its various aspects, will be apparent to those skilled in the art, some being apparent only after study, others being matters of routine mechanical design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. An archery bow, comprising:

a bottom limb with first and second ends;

a top limb with first and cantilevered second ends;

a leaf spring attached to said bottom limb; and a bowstring connected to said first end of said bottom limb and to said first end of said top limb;

wherein said top limb is pivotally connected to said bottom limb at a point distal from said second end of said top limb, such that the cantilevered second end of the top limb deforms said leaf spring when said bowstring is drawn back.

2. The bow of claim 1, wherein said leaf spring further comprises one or more leaves removably attached to said bottom limb.

3. The bow of claim 1 or 2, wherein said leaf spring connects to said bottom limb by an attachment mechanism comprising one or more bolts passing through said leaf spring and said bottom limb.

4. The bow of claim 1 or 2, further comprising an adjustable band, wherein said leaf spring is attached to said bottom limb by engaging the adjustable band tightly around said leaf spring and said bottom limb.

5. The bow of claim 1 or 2, wherein said top limb width tapers toward said second end and said pivotal connection to said bottom limb, creating an arrow rest for aiming.

6. The bow of claim 1 or 2, wherein said leaf spring includes a portion retaining said second end of the top limb.

7. The bow of claim 1 or 2, further comprising a friction reducer on said top limb second end.

8. The bow of claim 1 or 2, further comprising a friction reducing means on the top limb second end.

9. The bow of claims 7, wherein said friction reducer is selected from a group consisting of a roller and a captured ball bearing.

10. An archery bow comprising:

A bottom limb with first and second ends, wherein said second end has an axial slot extending from the tip of said second end to a point distal from the tip of said second end, a front slat, and a rear slat;

a top limb with first and second ends, wherein said second end is seized to fit movably within said axial slot in said bottom limb;

a bowstring connected to said first ends of said top and bottom limbs;

wherein the top limb is pivotally connected to the bottom limb at a point distal from the second end of the top limb, such that the cantilevered second end of the top limb fits movingly within the slot and deforms the front slat when the bowstring is drawn back.

11. The bow of claim 10, further comprising a leaf spring removably attached to said bottom limb in parallel contact with the front slat of said bottom limb.

12. The bow of claim 10, wherein said front slat includes a portion retaining said second end of the top limb.

13. An archery bow comprising:

A top limb with first and second ends;

a bottom limb with first and second ends;

pivot means pivotally connecting said top limb to said bottom limb;

spring means attached to said bottom limb for tensioning said top limb;

retaining means on said spring means for retaining said top limb; and a string spanning a space created by said top limb first end and said bottom limb first end.

14. The bow of claim 1, 2, 10, or 13, further comprising a handle attached to said bottom limb.

15. An archery bow comprising;

First and second opposing limbs pivotally connected with spaced distal ends;

a cantilevered leaf spring member connected to said second limb;

a cantilever connected to said first limb across a fulcrum and in direct pressure contact with said spring member, whereby intermediary structures including cords and pulleys are eliminated and friction is reduced, structural complexity is simplified, a natural limb tension equilibrium is achieved through pressure feed back across the fulcrum and performance is enhanced;

a bowstring spanning distal ends of said first and second opposing limbs such that drawing the bow string causes tension to be enacted onto said spring member.

16. The bow of claim 15, further comprising a handle connected to either of said first or second limbs.

* * * * *